US012758861B2

(12) United States Patent
Velasquez

(10) Patent No.: US 12,758,861 B2
(45) Date of Patent: Oct. 13, 2026

(54) TABLE TOP MINI-GOLF DEVICE

(71) Applicant: Wilfred Velasquez, Covina, CA (US)

(72) Inventor: Wilfred Velasquez, Covina, CA (US)

( * ) Notice: Subject to any disclaimer, the term of this patent is extended or adjusted under 35 U.S.C. 154(b) by 148 days.

(21) Appl. No.: 18/979,235

(22) Filed: Dec. 12, 2024

(65) Prior Publication Data

US 2026/0166414 A1 Jun. 18, 2026

(51) Int. Cl.
*A63F 7/06* (2006.01)
*A63F 7/30* (2006.01)
*A63F 7/40* (2006.01)

(52) U.S. Cl.
CPC ..... *A63F 7/0628* (2013.01); *A63F 7/0668* (2013.01); *A63F 7/30* (2013.01); *A63F 7/40* (2013.01); *A63F 2007/3005* (2013.01)

(58) Field of Classification Search
CPC ..... A63F 7/0628; A63F 7/0668; A63F 7/30; A63F 7/40; A63F 2007/3005
USPC ..... 273/108.2, 108.21, 317.2; 473/159, 173
See application file for complete search history.

(56) References Cited

U.S. PATENT DOCUMENTS 1,024,354 A * 4/1912 O'Donnell ..... A63F 7/0628 273/124 R
2,473,277 A * 6/1949 Cipyak ..... A63F 7/0628 273/108.2
2,827,299 A 3/1958 Dean
2,995,372 A 8/1961 Hines
3,360,265 A * 12/1967 Yabroudy ..... A63F 7/0628 473/169
3,801,101 A * 4/1974 Greenberg ..... A63F 7/0628 273/125 R
3,868,111 A 2/1975 Schuelke
3,884,469 A 5/1975 Morton
4,098,507 A 7/1978 Hudon
D300,436 S 3/1989 Jorgensen
5,480,167 A 1/1996 Johnson
8,951,135 B1 * 2/2015 Guyer ..... A63B 67/02 473/158
2007/0205553 A1 * 9/2007 Turley ..... A63F 7/0628 273/108.2

FOREIGN PATENT DOCUMENTS

CA 2483886 5/2006

* cited by examiner

*Primary Examiner* — Luan K Bui

(57) ABSTRACT

A table top mini-golf device includes a box and a golf area defined on the box. A plurality of holes each extends into an interior of the box. A plurality of ridges each extends upwardly from the golf area of the box and defines a plurality of uniquely shaped mini golf courses. The player attempts to roll a mini golf ball into each of the plurality of uniquely shaped mini golf courses during the game of mini golf and each hole is located in a respective one of the plurality of uniquely shaped mini golf courses. A ramp is located within the box and the ramp is sloped such that each mini golf ball which falls through a respective hole rolls downwardly along the ramp. A return opening extends through the box to enable the player access the mini golf ball that rolls down the ramp and exits the return opening.

16 Claims, 5 Drawing Sheets

TABLE TOP MINI-GOLF DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mini-golf devices and more particularly pertains to a new mini-golf device for playing a game of mini golf in any location. The device includes a plurality of ridges which extend upwardly from the box to define a plurality of mini golf courses on the box and a plurality of holes each located in a respective mini golf course. The device includes a plurality of mini golf balls and a plurality of mini golf clubs. A player employs one of the mini golf clubs to strike one of the mini golf balls into a chosen mini golf course in the attempt to sink the mini golf ball into the hole that is located in the chosen mini golf course.

(2) Description of Related Art Including Information Disclosed Under 37 CFR 1.97 and 1.98

The prior art relates to mini-golf devices including: a miniature golf game that includes a variety of moving parts which are assembled together to define a mini golf course; a miniature golf course device that includes a box with a plurality of holes distributed around the box to define a golf course on the box and a magnetic attracting member located within the box for magnetically engaging a game piece; a variety of mini golf devices which each at least includes a box and a series of barriers with are arranged in linear arrangement to define a plurality of mini golf courses on the box and, in at least one instance, includes ramps located in respective mini golf courses to increase the difficulty of navigating a mini golf ball through the mini golf courses; a mini golf game that includes a multiple level playing board which is structured to define a plurality of mini golf courses. In no instance does the prior art disclose a mini golf device that includes a box and a plurality of ridges extending upwardly from the box which are each structured to define a plurality of uniquely shaped mini golf courses and a ramp located within the box to deliver a mini golf ball which has fallen through a hole of a respective mini golf course to a return opening in the box.

BRIEF SUMMARY OF THE INVENTION

An embodiment of the disclosure meets the needs presented above by generally comprising a box and a golf area defined on the box. A plurality of holes each extends into an interior of the box. A plurality of ridges each extends upwardly from the golf area of the box and defines a plurality of uniquely shaped mini golf courses. The player attempts to roll a mini golf ball into each of the plurality of uniquely shaped mini golf courses during the game of mini golf and each hole is located in a respective one of the plurality of uniquely shaped mini golf courses. A ramp is located within the box and the ramp is sloped such that each mini golf ball which falls through a respective hole rolls downwardly along the ramp. A return opening extends through the box to enable the player access the mini golf ball that rolls down the ramp and exits the return opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
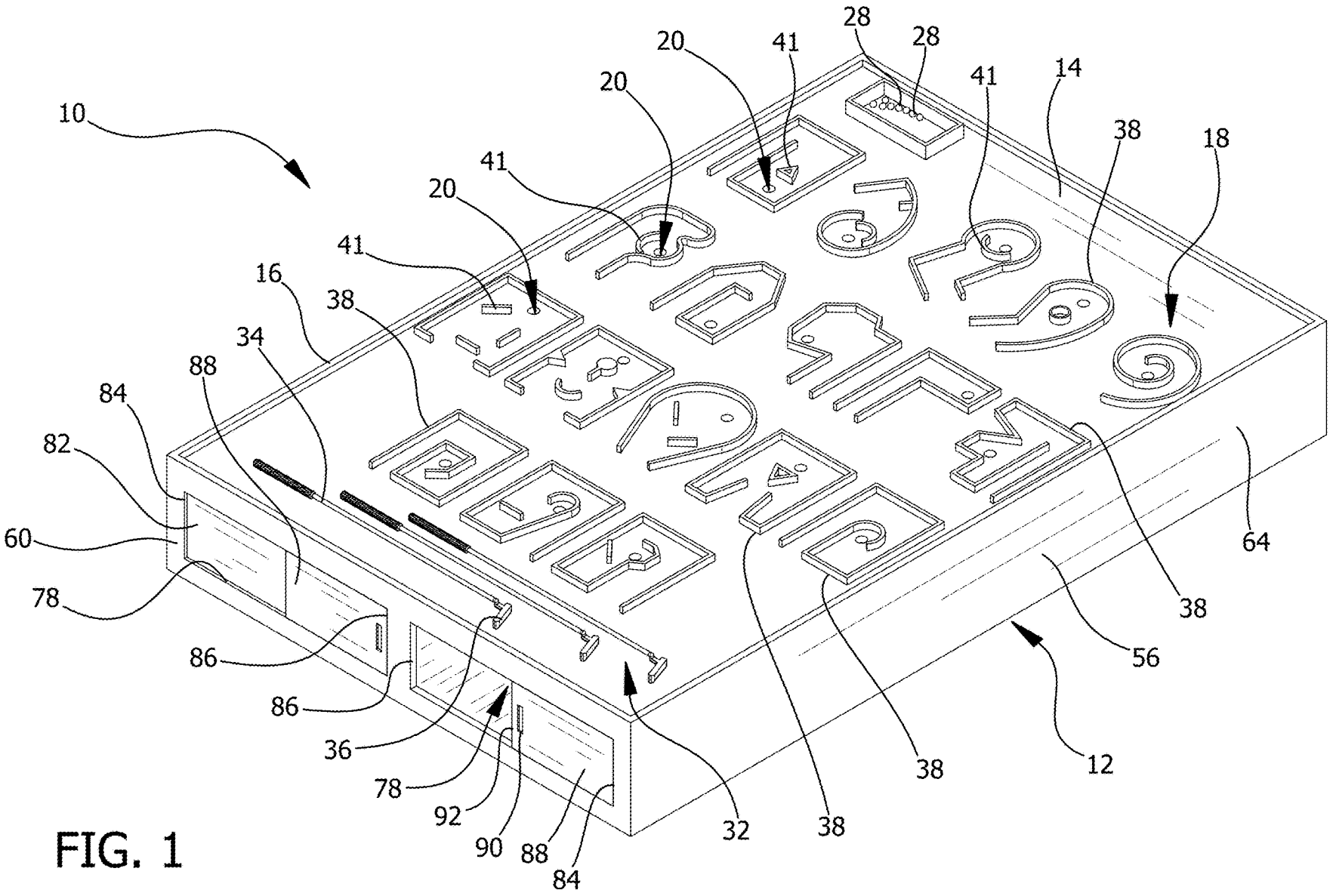
FIG. 1 is a top perspective view of a table top mini-golf device according to an embodiment of the disclosure.
Figure 2:
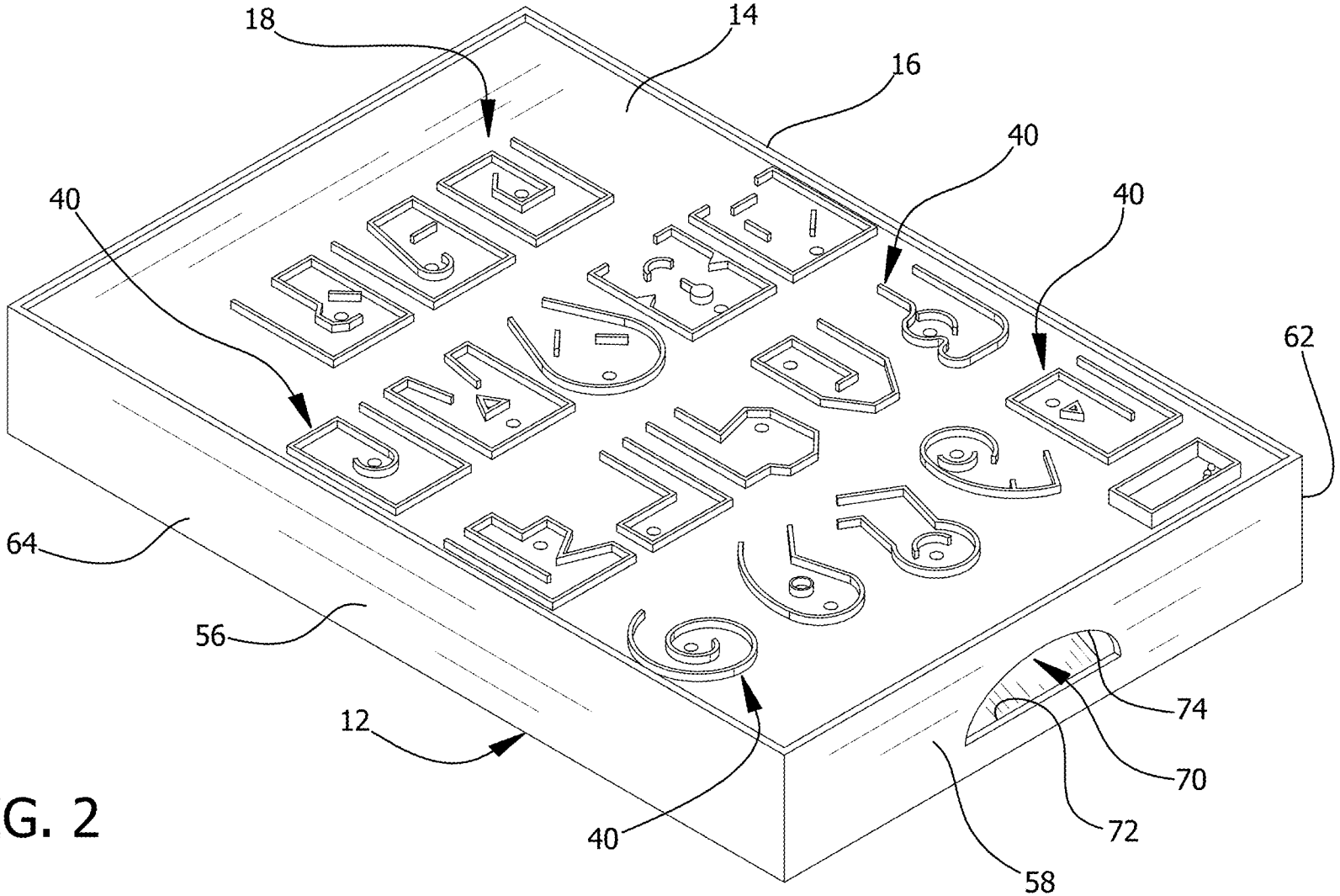
FIG. 2 is a front perspective view of an embodiment of the disclosure.
Figure 3:
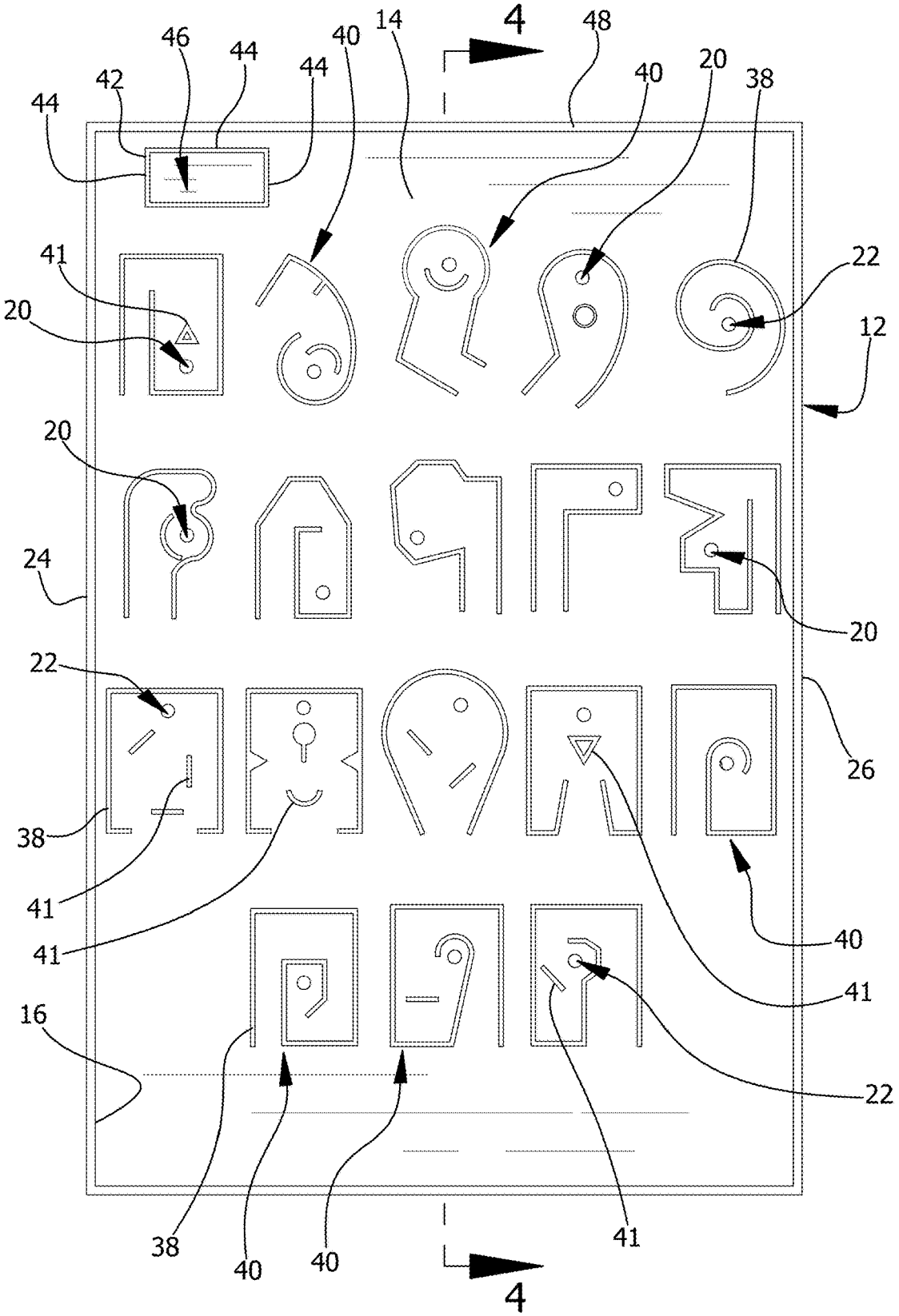
FIG. 3 is a top view of an embodiment of the disclosure.
Figure 4:
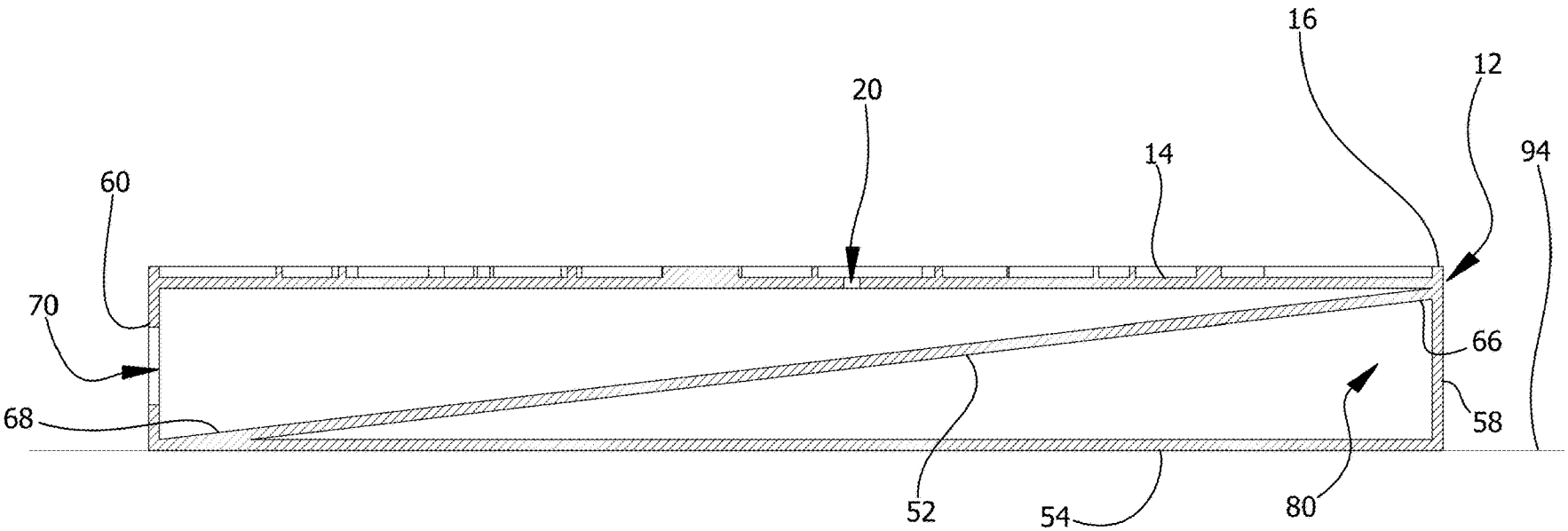
FIG. 4 is a cross sectional view taken along line 4-4 of FIG. 3 of an embodiment of the disclosure.
Figure 5:
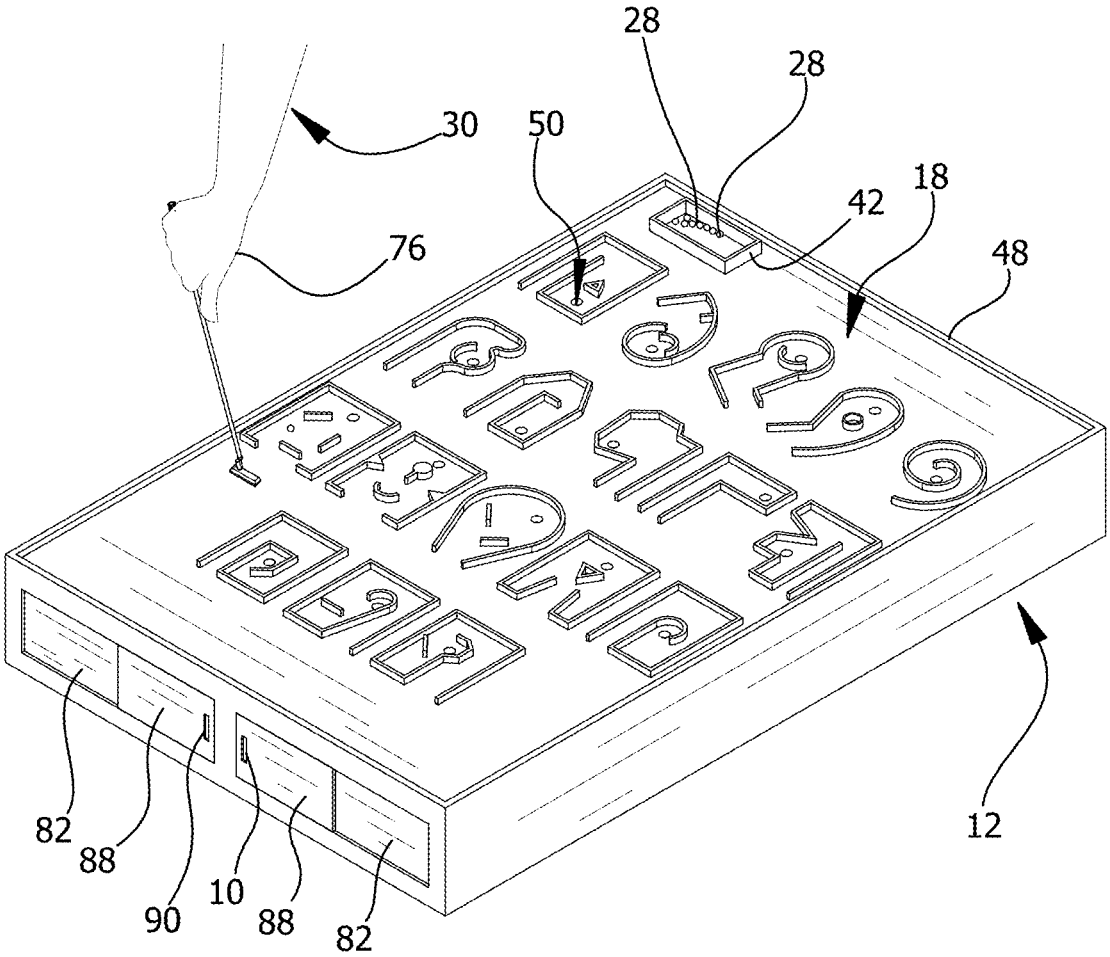
FIG. 5 is a perspective in-use view of an embodiment of the disclosure.

With reference now to the drawings, and in particular to FIGS. 1 through 5 thereof, a new mini-golf device embodying the principles and concepts of an embodiment of the disclosure and generally designated by the reference numeral 10 will be described.

As best illustrated in FIGS. 1 through 5, the table top mini-golf device 10 generally comprises a box 12 that has a top wall 14 and a perimeter border 16 surrounding the top wall 14 such that the perimeter border 16 defines a golf area 18 on the top wall 14. The box 12 has a plurality of holes 20 each extending through the top wall 14 and into an interior of the box 12 and the plurality of holes 20 is arranged in a plurality of rows 22 of the plurality of holes 20 on the top wall 14. The perimeter border 16 has a first lateral side 24 and a second lateral side 26 and each of the plurality of holes 20 which are located in a respective one of the plurality of rows 22 is staggered with respect to a line extending between the first lateral side 24 and the second lateral side 26.

A plurality of mini golf balls 28 is provided and each mini golf ball 28 of the plurality of mini golf balls 28 is positionable in the golf area 18 defined by the perimeter border 16 of the box 12 such that each mini golf ball 28 of the plurality of mini golf balls 28 is rollable on the top wall 14. Additionally, a respective one of the plurality of mini golf balls 28 is assigned to a player 30. A plurality of mini golf clubs 32 is provided and a respective one of the plurality of mini golf clubs 32 is assigned to the player 30. The respective mini golf club 32 is employed by the player 30 to strike the respective mini golf ball 28 to roll the respective mini golf ball 28 in the golf area 18 during the game of mini golf. Furthermore, each mini golf club 32 of the plurality of mini golf clubs 32 includes a shaft 34 and a head 36 which is oriented at an angle with the shaft 34. The shaft 34 of the respective mini golf club 32 is gripped by the player 30 for striking the respective mini golf ball 28 with the head 36 of the respective mini golf club 32 during the game of mini golf.

A plurality of ridges 38 each extends upwardly from the top wall 14 of the box 12 such that each ridge 38 of the plurality of ridges 38 is positioned in the golf area 18 defined by the perimeter border 16 of the box 12. Each ridge 38 of the plurality of ridges 38 is shaped to follow a unique path with respect to others of the plurality of ridges 38 such that each ridge 38 of the plurality of ridges 38 defines a respective one of a plurality of uniquely shaped mini golf courses 40. Furthermore, each ridge 38 of the plurality of ridges 38 enables the player 30 attempt to roll the mini golf ball 28 that is assigned to the player 30 into each of the plurality of uniquely shaped mini golf courses 40 during the game of mini golf. Each hole 20 of the plurality of holes 20 in the top wall 14 is located in a respective one of the plurality of uniquely shaped mini golf courses 40. The player 30 attempts to roll the mini golf ball 28 that is assigned to the player 30 into the hole 20 that is located in each of the plurality of mini golf courses 40 during the game of mini golf. Additionally, there may be eighteen uniquely shaped mini golf courses 40. A plurality of obstacles 41 extends upwardly from the top wall 14 of the box 12 and each obstacle 41 of the plurality of obstacles 41 is located in a respective one of the plurality of mini golf courses 40 to increase the difficulty of rolling the mini golf ball 28 into the hole 20 that is located in the respective mini golf course 40.

The plurality of ridges 38 including a storage ridge 42 which has a plurality of intersecting sides 44 which are perpendicularly oriented with each other such that the storage ridge 42 defines a rectangular storage area 46 for storing the plurality of mini golf balls 28. The perimeter border 16 that surrounds the top wall 14 of the box 12 has a front side 48. The storage ridge 42 is located between the plurality of ridges 38 which surround a frontmost one 50 of the plurality of rows 22 of holes 20 and the front side 48 of the perimeter border 16. Furthermore, the storage ridge 42 is positioned closer to the first lateral side 24 of the perimeter border 16 than the second lateral side 26 of the perimeter border 16.

A ramp 52 is located within the box 12 such that each mini golf ball 28 of the plurality of mini golf balls 28 falls onto the ramp 52 when each mini golf ball 28 of the plurality of mini golf balls 28 falls through a respective one of the plurality of holes 20 in the top wall 14 of the box 12. The ramp 52 is sloped such that each mini golf ball 28 which falls through the respective hole 20 rolls downwardly along the ramp 52. The box 12 has a bottom wall 54 and an outer wall 56 extending between the bottom wall 54 and the top wall 14. The outer wall 56 has a front side 58, a back side 60, a first lateral side 62 and a second lateral side 64 and the ramp 52 extends between the front side 58 and the back side 60 of the outer wall 56. The ramp 52 has a front end 66 which is aligned with an intersection between the top wall 14 of the box 12 and the back side 60 of the outer wall 56 of the box 12. Additionally, the ramp 52 has a back end 68 which is aligned with an intersection between the bottom wall 54 of the box 12 and the front side 58 of the outer wall 56 of the box 12. The ramp 52 slopes downwardly between the front side 58 of the outer wall 56 and the back side 60 of the outer wall 56 such that each mini golf ball 28 which falls through a respective one of the plurality of holes 20 in the top wall 14 of the box 12 rolls toward the back side 60 of the outer wall 56. Additionally, the ramp 52 extends between the first lateral side 62 and the second lateral side 64 of the outer wall 56.

A return opening 70 extends through the box 12 such that each mini golf ball 28 of the plurality of mini golf balls 28 which rolls downwardly along the ramp 52 exits the return opening 70. Furthermore, the return opening 70 enables the player 30 to access the mini golf ball 28 that exits the return opening 70. The return opening 70 extends through the front side 58 of the outer wall 56 of the box 12 such that the ramp 52 slopes downwardly below the return opening 70. The return opening 70 has a lower bounding edge 72 which extends along a line is oriented parallel to the bottom wall 54 of the box 12. Additionally, the return opening 70 has an upper bounding edge 74 which curves upwardly from the lower bounding edge 72 such that the return opening 70 has a semi-circular shape. The semi-circular shape of the return opening 70 accommodates a hand 76 of the player 30 when the player 30 reaches their hand 76 through the return opening 70. Furthermore, the return opening 70 is centrally located between the first lateral side 62 and the second lateral side 64 of the outer wall 56 of the box 12.

A pair of storage openings 78 each extends through the box 12. Each mini golf club 32 of the plurality of mini golf clubs 32 is insertable through a respective one of the pair of storage openings 78 for storing each mini golf club 32 of the plurality of mini golf clubs 32 within the box 12. Additionally, each storage opening 78 of the pair of storage openings 78 extends through the back side 60 of the outer wall 56 of the box 12 such that each mini golf club 32 of the plurality of mini golf clubs 32 is stored in a space 80 defined between the ramp 52 and the bottom wall 54 of the box 12. Each storage opening 78 of the pair of storage openings 78 is elongated along an axis extending between the first lateral side 62 and the second lateral side 64 of the outer wall 56 of the box 12. The pair of storage openings 78 is spaced apart from each other and is distributed between the first lateral side 62 and the second lateral side 64 of the outer wall 56.

A pair of first doors 82 is each located in a respective one of the pair of storage openings 78 and each first door 82 of the pair of first doors 82 is fixed in the respective storage opening 78. Each storage opening 78 of the pair of storage openings 78 has a first lateral bounding edge 84 and a second lateral bounding edge 86. Furthermore, each first door 82 of the pair of first doors 82 extends from the first lateral bounding edge 84 of the respective storage opening 78 toward the second lateral bounding edge 86 of the respective storage opening 78. A pair of second doors 88 is each slidably located in a respective one of the pair of storage openings 78. Each second door 88 of the pair of second doors 88 is slidable into a closed position having each second door 88 of the pair of second doors 88 extending from the second lateral bounding edge 86 of the respective storage opening 78 and a respective one of the pair of first doors 82 for closing the respective storage opening 78. Conversely, each second door 88 of the pair of second doors 88 is slidable into an open position having each second door 88 of the pair of second doors 88 being spaced from the second lateral bounding edge 86 of the respective storage opening 78 for exposing a portion of the respective storage opening 78 which extends between the second lateral bounding edge 86 of the respective storage opening 78 and a respective first door 82.

A pair of handles 90 is each attached to an outwardly facing surface 92 of a respective one of the pair of second doors 88. Each handle 90 of the pair of handles 90 can be gripped by the player 30 such that the player 30 can slide the respective second door 88 between the closed position and the open position. Additionally, each handle 90 of the pair of handles 90 is located adjacent to a respective lateral edge 92 of the respective second door 88.

In use, the box 12 is placed on a support surface 94, such as a table top for example, and the player 30 removes a mini golf ball 28 from the rectangular storage area 46 defined by the storage ridge 42 and the player 30 removes a mini golf club 32 from the box 12. The player 30 places the mini golf ball 28 on the golf area 18 of the box 12 and the player 30 employs the mini golf club 32 to strike the mini golf ball 28 into a chosen one of the plurality of mini golf courses 40 in the attempt to sink the mini golf ball 28 into the hole 20 associated with the chosen mini golf course 40. The mini golf ball 28 is retrieved from the return opening 70 the mini golf ball 28 is again placed on the golf area 18 to continue the game of mini golf. The player 30 can strike the mini golf ball 28 into as many or as few of the mini golf courses 40 as they so choose.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A table top mini-golf device for playing mini-golf indoors, said device comprising:

a box having a top wall and a perimeter border surrounding said top wall such that said perimeter border defines a golf area on said top wall, said box having a plurality of holes each extending through said top wall and into an interior of said box;

a plurality of mini golf balls, each mini golf ball of said plurality of mini golf balls being positionable in said golf area defined by said perimeter border of said box such that each mini golf ball of said plurality of mini golf balls is rollable on said top wall, a respective one of said plurality of mini golf balls being assigned to a player;

a plurality of mini golf clubs, a respective one of said plurality of mini golf clubs being assigned to the player wherein said respective mini golf club is configured to be employed by the player to strike said respective mini golf ball to roll said respective mini golf ball in said golf area during the game of mini golf;

a plurality of ridges, each ridge of said plurality of ridges extending upwardly from said top wall of said box such that each ridge of said plurality of ridges is positioned in said golf area defined by said perimeter border of said box, each ridge of said plurality of ridges being shaped to follow a unique path with respect to others of said plurality of ridges such that each ridge of said plurality of ridges defines a respective one of a plurality of uniquely shaped mini golf courses wherein each ridge of said plurality of ridges is configured to have the player attempt to roll said mini golf ball that is assigned to the player into each of said plurality of uniquely shaped mini golf courses during the game of mini golf, each hole of said plurality of holes in said top wall being located in a respective one of said plurality of uniquely shaped mini golf courses wherein each mini golf course of said plurality of mini golf courses is configured to have the player attempt to roll said mini golf ball that is assigned to the player into said hole that is located in each of said plurality of mini golf courses during the game of mini golf;

a ramp being located within said box such that each mini golf ball of said plurality of mini golf balls falls onto said ramp when each mini golf ball of said plurality of mini golf balls falls through a respective one of said plurality of holes in said top wall of said box, said ramp being sloped such that each mini golf ball which falls through said respective hole rolls downwardly along said ramp;

a return opening extending through said box such that each mini golf ball of said plurality of mini golf balls which rolls downwardly along said ramp exits said return opening wherein said return opening is configured to have the player access said mini golf ball that exits said return opening; and a pair of storage openings, each storage opening of said pair of storage openings extending through said box, each mini golf club of said plurality of mini golf clubs being insertable through a respective one of said pair of storage openings for storing each mini golf club of said plurality of mini golf clubs within said box.

2. The table top mini-golf device according to claim 1, wherein said plurality of holes is arranged in a plurality of rows of said plurality of holes on said top wall.

3. The table top mini-golf device according to claim 2, wherein:

said perimeter border has a first lateral side and a second lateral side; and each of said plurality of holes which are located in a respective one of said plurality of rows is staggered with respect to a line extending between said first lateral side and said second lateral side.

4. The table top mini-golf device according to claim 3, wherein:

said perimeter border surrounding said top wall of said box has a front side;

said plurality of ridges includes a storage ridge which has a plurality of intersecting sides which are perpendicularly oriented with each other such that said storage ridge defines a rectangular storage area for storing said plurality of mini golf balls;

said storage ridge is located between said plurality of ridges which surround a frontmost one of said plurality of rows of holes and said front side of said perimeter border; and said storage ridge is positioned closer to said first lateral side of said perimeter border than said second lateral side of said perimeter border.

5. The table top mini-golf device according to claim 1, wherein:

said box has a bottom wall and an outer wall extending between said bottom wall and said top wall;

said outer wall has a front side and a back side and a first lateral side and a second lateral side;

said ramp extends between said front side and said back side of said outer wall; and said ramp extends between said first lateral side and said second lateral side of said outer wall.

6. The table top mini-golf device according to claim 5, wherein:

said ramp has a front end being aligned with an intersection between said top wall of said box and said back side of said outer wall of said box; and said ramp has a back end being aligned with an intersection between said bottom wall of said box and said front side of said outer wall of said box having said ramp sloping downwardly between said front side of said outer wall and said back side of said outer wall such that each mini golf ball which falls through a respective one of said plurality of holes in said top wall of said box rolls toward said back side of said outer wall.

7. The table top mini-golf device according to claim 1, wherein:

said box has an outer wall:

said outer wall has a front side and a first lateral side and a second lateral side;

said return opening extends through said front side of said outer wall of said box such that said ramp slopes downwardly below said return opening; and said return opening is centrally located between said first lateral side and said second lateral side of said outer wall of said box.

8. The table top mini-golf device according to claim 1, wherein:

said return opening has a lower bounding edge which extends along a line being oriented parallel to a bottom wall of said box; and said return opening has an upper bounding edge which curves upwardly from said lower bounding edge such that said return opening has a semi-circular shape wherein said return opening is configured to accommodate a hand of the player when the player reaches their hand through said return opening.

9. The table top mini-golf device according to claim 5, wherein each storage opening of said pair of storage openings extends through said back side of said outer wall of said box such that each mini golf club of said plurality of mini golf clubs is stored in a space defined between said ramp and said bottom wall of said box.

10. The table top mini-golf device according to claim 1, wherein:

said box has an outer wall;

said outer wall has a first lateral side and a second lateral side;

each storage opening of said pair of storage openings is elongated along an axis extending between said first lateral side and said second lateral side of said outer wall of said box; and said pair of storage openings is spaced apart from each other and is distributed between said first lateral side and said second lateral side of said outer wall.

11. The table top mini-golf device according to claim 1, wherein:

said table top mini-golf device includes a pair of first doors, each first door of said pair of first doors being located in a respective one of said pair of storage openings;

each first door of said pair of first doors being fixed in said respective storage opening;

said device includes a pair of second doors; and each second door of said pair of second doors is slidably located in a respective one of said pair of storage openings.

12. The table top mini-golf device according to claim 11, wherein:

each storage opening of said pair of storage openings has a first lateral bounding edge and a second lateral bounding edge; and each first door of said pair of first doors extends from said first lateral bounding edge of said respective storage opening toward said second lateral bounding edge of said respective storage opening.

13. The table top mini-golf device according to claim 12, wherein each second door of said pair of second doors is slidable into a closed position having each second door of said pair of second doors extending from said second lateral bounding edge of said respective storage opening and a respective one of said pair of first doors for closing said respective storage opening.

14. The table top mini-golf device according to claim 12, wherein each second door of said pair of second doors is slidable into an open position having each second door of said pair of second doors being spaced from said second lateral bounding edge of said respective storage opening for exposing a portion of said respective storage opening which extends between said second lateral bounding edge of said respective storage opening and a respective first door.

15. The table top mini-golf device according to claim 11, wherein:

said table top mini-golf device includes a pair of handles; and each handle of said pair of handles is attached to an outwardly facing surface of a respective one of said pair of second doors wherein each handle of said pair of handles is configured to be gripped by the player such that the player can slide said respective second door between a closed position and an open position; and each handle of said pair of handles is located adjacent to a respective lateral edge of said respective second door.

16. A table top mini-golf device for playing mini-golf indoors, said device comprising:

a box having a top wall and a perimeter border surrounding said top wall such that said perimeter border defines a golf area on said top wall, said box having a plurality of holes each extending through said top wall and into an interior of said box, said plurality of holes being arranged in a plurality of rows of said plurality of holes on said top wall, said perimeter border having a first lateral side and a second lateral side, each of said plurality of holes which are located in a respective one of said plurality of rows being staggered with respect to a line extending between said first lateral side and said second lateral side;

a plurality of mini golf balls, each mini golf ball of said plurality of mini golf balls being positionable in said golf area defined by said perimeter border of said box such that each mini golf ball of said plurality of mini golf balls is rollable on said top wall, a respective one of said plurality of mini golf balls being assigned to a player;

a plurality of mini golf clubs, a respective one of said plurality of mini golf clubs being assigned to the player wherein said respective mini golf club is configured to be employed by the player to strike said respective mini golf ball to roll said respective mini golf ball in said golf area during the game of mini golf, each mini golf club of said plurality of mini golf clubs including a shaft and a head being oriented at an angle with said shaft wherein said shaft of said respective mini golf club is configured to be gripped by the player for striking said respective mini golf ball with said head of said respective mini golf club during the game of mini golf;

a plurality of ridges, each ridge of said plurality of ridges extending upwardly from said top wall of said box such that each ridge of said plurality of ridges is positioned in said golf area defined by said perimeter border of said box, each ridge of said plurality of ridges being shaped to follow a unique path with respect to others of said plurality of ridges such that each ridge of said plurality of ridges defines a respective one of a plurality of uniquely shaped mini golf courses wherein each ridge of said plurality of ridges is configured to have the player attempt to roll said mini golf ball that is assigned to the player into each of said plurality of uniquely shaped mini golf courses during the game of mini golf, each hole of said plurality of holes in said top wall being located in a respective one of said plurality of uniquely shaped mini golf courses wherein each mini golf course of said plurality of mini golf courses is configured to have the player attempt to roll said mini golf ball that is assigned to the player into said hole that is located in each of said plurality of mini golf courses during the game of mini golf, said plurality of ridges including a storage ridge which has a plurality of intersecting sides which are perpendicularly oriented with each other such that said storage ridge defines a rectangular storage area for storing said plurality of mini golf balls, said perimeter border surrounding said top wall of said box having a front side, said storage ridge being located between said plurality of ridges which surround a frontmost one of said plurality of rows of holes and said front side of said perimeter border, said storage ridge being positioned closer to said first lateral side of said perimeter border than said second lateral side of said perimeter border;

a ramp being located within said box such that each mini golf ball of said plurality of mini golf balls falls onto said ramp when each mini golf ball of said plurality of mini golf balls falls through a respective one of said plurality of holes in said top wall of said box, said ramp being sloped such that each mini golf ball which falls through said respective hole rolls downwardly along said ramp, said box having a bottom wall and an outer wall extending between said bottom wall and said top wall, said outer wall having a front side and a back side and a first lateral side and a second lateral side, said ramp extending between said front side and said back side of said outer wall, said ramp having a front end being aligned with an intersection between said top wall of said box and said back side of said outer wall of said box, said ramp having a back end being aligned with an intersection between said bottom wall of said box and said front side of said outer wall of said box having said ramp sloping downwardly between said front side of said outer wall and said back side of said outer wall such that each mini golf ball which falls through a respective one of said plurality of holes in said top wall of said box rolls toward said back side of said outer wall, said ramp extending between said first lateral side and said second lateral side of said outer wall;

a return opening extending through said box such that each mini golf ball of said plurality of mini golf balls which rolls downwardly along said ramp exits said return opening wherein said return opening is configured to have the player access said mini golf ball that exits said return opening, said return opening extending through said front side of said outer wall of said box such that said ramp slopes downwardly below said return opening, said return opening having a lower bounding edge which extends along a line being oriented parallel to said bottom wall of said box, said return opening having an upper bounding edge which curves upwardly from said lower bounding edge such that said return opening has a semi-circular shape wherein said return opening is configured to accommodate a hand of the player when the player reaches their hand through said return opening, said return opening being centrally located between said first lateral side and said second lateral side of said outer wall of said box;

a pair of storage openings, each storage opening of said pair of storage openings extending through said box, each mini golf club of said plurality of mini golf clubs being insertable through a respective one of said pair of storage openings for storing each mini golf club of said plurality of mini golf clubs within said box, each storage opening of said pair of storage openings extending through said back side of said outer wall of said box such that each mini golf club of said plurality of mini golf clubs is stored in a space defined between said ramp and said bottom wall of said box, each storage opening of said pair of storage openings being elongated along an axis extending between said first lateral side and said second lateral side of said outer wall of said box, said pair of storage openings being spaced apart from each other and being distributed between said first lateral side and said second lateral side of said outer wall;

a pair of first doors, each first door of said pair of first doors being located in a respective one of said pair of storage openings, each first door of said pair of first doors being fixed in said respective storage opening, each storage opening of said pair of storage openings having a first lateral bounding edge and a second lateral bounding edge, each first door of said pair of first doors extending from said first lateral bounding edge of said respective storage opening toward said second lateral bounding edge of said respective storage opening;

a pair of second doors, each second door of said pair of second doors being slidably located in a respective one of said pair of storage openings, each second door of said pair of second doors being slidable into a closed position having each second door of said pair of second doors extending from said second lateral bounding edge of said respective storage opening and a respective one of said pair of first doors for closing said respective storage opening, each second door of said pair of second doors being slidable into an open position having each second door of said pair of second doors being spaced from said second lateral bounding edge of said respective storage opening for exposing a portion of said respective storage opening which extends between said second lateral bounding edge of said respective storage opening and a respective first door; and a pair of handles, each handle of said pair of handles being attached to an outwardly facing surface of a respective one of said pair of second doors wherein each handle of said pair of handles is configured to be gripped by the player such that the player can slide said respective second door between said closed position and said open position, each handle of said pair of handles being located adjacent to a respective lateral edge of said respective second door.

* * * * *